US009322089B2

(12) United States Patent
Biondo et al.

(10) Patent No.: US 9,322,089 B2
(45) Date of Patent: Apr. 26, 2016

(54) NICKEL-BASE ALLOY FOR GAS TURBINE APPLICATIONS

(75) Inventors: Charles Biondo, Jupiter, FL (US); J. Page Strohl, Stuart, FL (US); Jeffery W. Samuelson, Jupiter, FL (US); Gerhard E. Fuchs, Gainesville, FL (US); Stanley T. Wlodek, San Diego, CA (US); Ramona T. Wlodek, legal representative, San Diego, CA (US)

(73) Assignee: Alstom Technology Ltd, Baden (CH)

( * ) Notice: Subject to any disclaimer, the term of this patent is extended or adjusted under 35 U.S.C. 154(b) by 555 days.

(21) Appl. No.: 11/492,423

(22) Filed: Jul. 25, 2006

(65) Prior Publication Data

US 2010/0080729 A1 Apr. 1, 2010

Related U.S. Application Data

(60) Provisional application No. 60/810,363, filed on Jun. 2, 2006.

(51) Int. Cl.

| | |
|---|---|
| ***C22C 19/05*** | (2006.01) |
| ***C22F 1/10*** | (2006.01) |
| ***C22C 19/03*** | (2006.01) |

(52) U.S. Cl.

CPC . *C22F 1/10* (2013.01); *C22C 19/03* (2013.01); *C22C 19/05* (2013.01)

(58) Field of Classification Search

CPC ..... C22F 1/10; C22C 19/05; C22C 19/056

See application file for complete search history.

(56) References Cited

U.S. PATENT DOCUMENTS

| | | | | | |
|---|---|---|---|---|---|
| 3,929,467 | A | * | 12/1975 | Davies et al. | 75/585 |
| 4,169,742 | A | | 10/1979 | Wukusick et al. | |
| 4,461,659 | A | | 7/1984 | Harris | |
| 4,529,452 | A | * | 7/1985 | Walker | 148/527 |
| 5,228,284 | A | * | 7/1993 | Carruthers et al. | 60/806 |
| 5,399,313 | A | * | 3/1995 | Ross et al. | 420/448 |
| 5,989,733 | A | * | 11/1999 | Warnes et al. | 428/652 |
| 6,416,596 | B1 | | 7/2002 | Wood et al. | |

(Continued)

FOREIGN PATENT DOCUMENTS

| | | |
|---|---|---|
| EP | 0032812 | 7/1981 |
| EP | 0849370 | 6/1998 |

(Continued)

OTHER PUBLICATIONS

Baig Gyn Choi, et al., "Eta Phase Formation During Thermal Exposure and Its Effect on Mechanical Properties in Ni-Base Superalloy GTD 111", Superalloys, 2004.

(Continued)

*Primary Examiner* — Jessee Roe

(74) *Attorney, Agent, or Firm* — Shook, Hardy & Bacon L.L.P.

(57) ABSTRACT

A nickel-based alloy suitable for casting gas turbine components having a lower density and basic heat treating process while achieving improved strength is disclosed. Multiple embodiments of the alloy are disclosed capable of providing both directionally-solidified and equiaxed castings. Also disclosed is a method of making a cast and heat treated article utilizing the improved nickel-base alloy.

7 Claims, 12 Drawing Sheets

(56) References Cited

U.S. PATENT DOCUMENTS

| | | | |
|---|---|---|---|
| 6,908,518 | B2 | 6/2005 | Bouse et al. |
| 2002/0005233 | A1 | 1/2002 | Schirra |
| 2003/0111138 | A1 | 6/2003 | Cetel |
| 2004/0109786 | A1 | 6/2004 | O'Hara |
| 2005/0092398 | A1 | 5/2005 | Kobayashi et al. |
| 2006/0137179 | A1 | 6/2006 | Gorman |

FOREIGN PATENT DOCUMENTS

| | | | |
|---|---|---|---|
| EP | 1013781 | | 6/2000 |
| GB | 943141 | * | 11/1963 |
| JP | 03-039435 | | 2/1991 |
| RU | 2112069 C1 | | 5/1998 |

OTHER PUBLICATIONS

Nickel Development Insitute, "High-Temperature, High Strengh, Nickel Base Alloys", Publication No. 393, Oct. 1997.

C.T. Sims, "Prediction of Phase Composition", Chp. 8, Superalloys II, John Wiley & Sons, ISBN 0-471-01147.9 (1987).

S.T. Wlodek, "The Stability of Superalloys", Long Term Stability of High Temperature Materials, TMS, ISBN 0-87339-453-4 (1999) p. 3-40.

L.R. Woodyatt, et al., "Prediction of Sigma-Type Phase Occurance From Compositions in austenitic Superalloys", Trans. AIME (1966), p. 109-111.

English Translation of the Chinese Office Action of Mar. 10, 2010, Chinese Patent Application No. 200780035516.8, 2 pages.

Chinese Patent Publication 1432658A counterpart, US 2003/111138, 18 pages.

* cited by examiner

NICKEL-BASE ALLOY FOR GAS TURBINE APPLICATIONS

CROSS-REFERENCE TO RELATED APPLICATIONS

This application claims the benefit of U.S. Provisional Application No. 60/810,363 filed Jun. 2, 2006.

STATEMENT REGARDING FEDERALLY SPONSORED RESEARCH OR DEVELOPMENT

Not Applicable.

TECHNICAL FIELD

The present invention relates to gas turbines. More particularly, embodiments of the present invention relate to nickel-based alloys for use in casting gas turbine components.

BACKGROUND OF THE INVENTION

Gas turbine engines are known to operate in extreme environments exposing the engine components, especially those in the turbine section, to high operating temperatures and stresses. In order for the turbine components to endure these conditions, it is necessary that they are manufactured from a material having properties capable of withstanding prolonged exposure to such elevated temperatures and operating stresses, while receiving adequate cooling to lower their effective operating temperatures. This is especially true for the turbine buckets, or blades, as well as nozzles, or vanes, which are directly in the hot gas path stream of a combustion section.

In an effort to improve the efficiency of a gas turbine engine, operating temperatures can be increased in the combustion section so as to more completely burn the fuel. As a result, the temperatures in the turbine section are increased as well. For turbine materials to operate at a higher temperature without compromising component integrity, either additional cooling to the turbine components or improved material capability is required. However, by redirecting air to cool turbine components, the amount of air available for the combustion process is reduced, lowering its efficiency. This is counter productive to the goal of improving gas turbine efficiency by raising the operating temperature. Therefore, it is desirable to provide the operating improvements without reducing present air flow levels and engine efficiency.

A result of increased firing temperatures is further structural change in the material. That is, as operating temperatures increase for a given material, its ability to bear load decreases. As operating temperatures for gas turbine engines have increased over time in order to improve engine efficiency, a number of materials have been introduced having improved temperature capability. One such example is an alloy commonly referred to as CM-247 produced by Cannon-Muskegon Corporation of Muskegon, Mich. A form of this alloy is disclosed in U.S. Pat. No. 4,461,659. This alloy is one of many that have been developed having improved strength by reducing grain boundary cracking.

Another alloy improvement for gas turbine applications was developed by The General Electric Company. GTD-111, a nickel-based alloy having improved hot corrosion resistance, was developed for use in producing gas turbine blades and vanes. Properties of this alloy are disclosed in U.S. Pat. Nos. 6,416,596 and 6,428,637.

Furthermore, in addition to improved alloys, casting techniques have been developed to improve the strength of buckets and nozzles and other gas turbine components. As one skilled in the art of gas turbine airfoils will understand, the strength of a poured casting, and any inherent weakness therein, are a function of the size and location of the boundaries between the grains of the casting. Specifically, casting techniques have evolved from a conventional, or equiaxed, process where a metal is poured and grain boundaries are free to form as the part cools, to a directionally solidified (DS) casting process where metal is poured and cooled in a manner so as to only form grain boundaries in a single direction, preferably so that the <001> crystallographic direction is parallel to the longitudinal direction of the airfoil. By aligning the grain boundaries, typically the weakest portion of a casting, in a direction generally perpendicular to the load on the airfoil, significant improvements in casting strength, ductility, and resistance to thermal fatigue are realized. Most recently, enhancements have been made in the casting process so as to eliminate the grain boundaries altogether by cooling the castings in a manner so as to form a single crystal, or grain, structure, thereby eliminating the grain boundaries. This type of casting is the strongest type of casting to date, however, it is the most expensive casting to manufacture, due to the various processing requirements and alloy costs. Typically, single crystal castings are limited to applications where extremely high temperatures are found, excessively high mechanical loads exist, or turbine geometry dictates such a casting. An additional issue with respect to the casting process and alloy utilized pertains to the required processing. That is, depending on the casting technique and alloy involved, time consuming and expensive processes must occur to form the turbine component of that particular alloy.

Although significant enhancements have been made in alloy development, cooling technology, and casting processes, there is still significant margin for further improvements. Specifically, there is an industry need for an alloy having at least the capabilities of state-of-the-art alloys, yet have improved tensile strength, better castability, reduced operating stresses, and lower manufacturing costs.

BRIEF SUMMARY OF THE INVENTION

The present invention provides embodiments of a nickel-based alloy suitable for the production of gas turbine components having improved stability, mechanical properties, and lower operating stresses. One such stress reduction is found in the longitudinal stress, which is a function of alloy density, which for the alloys disclosed herein is lower than other well-known alloys used in gas turbine applications. Furthermore, the nickel-based alloy undergoes a heat treatment process without the use of excessively long high-temperature furnace schedules while also having a greater window at which such heat treatment can occur.

Compositions of nickel-based alloys suitable for multiple forms of investment casting are disclosed. This includes a composition suitable for equiaxed casting and for directionally solidified (DS) casting. In a further aspect of the present invention, a method of making a cast and heat treated article from the nickel-based alloy is provided comprising of the elemental composition as well as the heat treatment process.

BRIEF DESCRIPTION OF THE SEVERAL VIEWS OF THE DRAWING

The present invention is described in detail below with reference to the attached drawing figures, wherein.

DETAILED DESCRIPTION OF THE INVENTION

Figure 1:
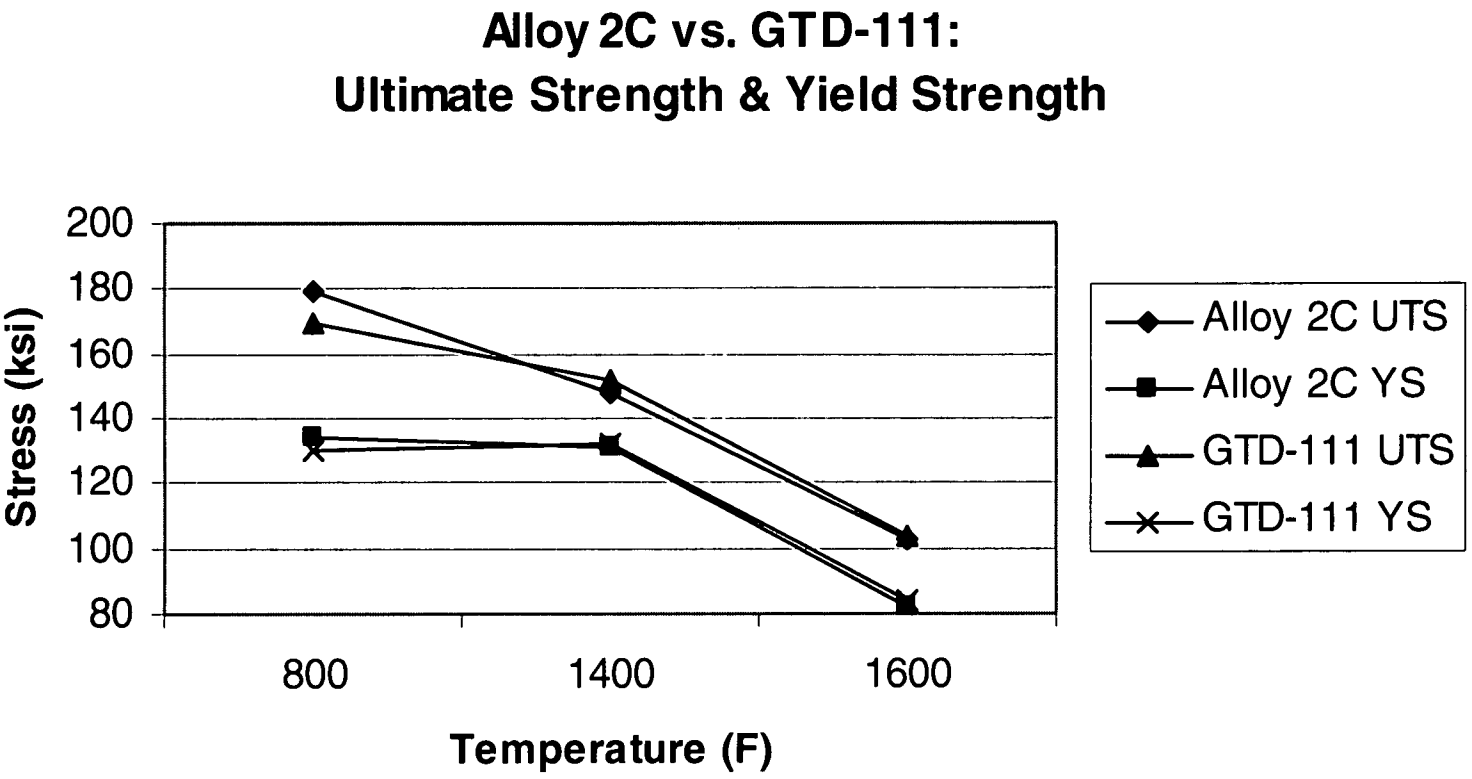
FIG. 1 is a chart depicting ultimate tensile strength and yield strength versus temperature for an alloy embodiment of the present invention compared to a prior art alloy.

The subject matter of the present invention is described with specificity herein to meet statutory requirements. However, the description itself is not intended to limit the scope of this patent. Rather, the inventors have contemplated that the claimed subject matter might also be embodied in other ways, to include different steps or combinations of steps similar to the ones described in this document, in conjunction with other present or future technologies. Moreover, although the terms "step" and/or "block" may be used herein to connote different elements of methods employed, the terms should not be interpreted as implying any particular order among or between various steps herein disclosed unless and except when the order of individual steps is explicitly described.

The present invention provides a nickel-based alloy suitable for production of gas turbine components and method of making a cast and heat-treated nickel-based alloy. An exemplary embodiment of the present invention is described below.

For clarity purposes, it is best to identify some of the common terminology that will be discussed in greater detail with respect to embodiments of the present invention. A "gas turbine engine," as the term is utilized herein, is an engine which provides mechanical output in the form of either thrust for propelling a vehicle or shaft power for driving an electrical generator. Gas turbine engines typically comprise a compressor, at least one combustor, and a turbine. A "blade", as the term is utilized herein, is an airfoil attached to a disk that rotates about a shaft of the gas turbine engine. Blades are used to either compress air flow passing through a compressor or to rotate the disk, and shaft of a turbine, by way of air passing along the shaped airfoil surface. The term "blade" is often used interchangeably with "bucket," and is done so herein, and is not meant to limit the nature of the term. A "vane," as the term is utilized herein, is a stationary airfoil that is typically found in both compressor and turbine sections and serves to redirect the flow of air passing through a compressor or turbine. The term "vane" is often used interchangeably with "nozzle", and is done so herein, and is not meant to limit the nature of the term. These types of airfoils are often cast from a liquid metal. Metal can be poured and cooled in a variety of means including to form equiaxed (EQ) and directionally-solidified (DS) castings. In an equiaxed casting, as one skilled in the art will understand, the casting is allowed to cool such that the grain boundaries of the solidified metal are free to form in any direction. In a DS casting, the metal is cooled in a direction so as to form a set of grain boundaries that extend in a specific direction.

An alloy having excellent casting properties, lower density and better stability has been developed by the inventors. The alloy has a range of acceptable chemistries, depending on the type of casting process to be utilized, each of which results in improved mechanical properties. This has been accomplished with chemistries that are free of expensive elements such as Rhenium (approximately $800.00/lb.) or very reactive elements such as Zirconium and Hafnium.

The nickel-based alloy of the present invention, as originally conceived by the inventors, consists essentially of about the composition by weight as tabulated in Table 1 below:

TABLE 1

| Alloy Composition | |
|---|---|
| Element | Weight Percent |
| Aluminum | 3.20-3.80 |
| Titanium | 4.00-5.30 |
| Tantalum | 2.20-2.70 |
| Chromium | 11.90-12.30 |
| Cobalt | 11.80-12.50 |
| Iron | 0.0-0.20 |
| Copper | 0.0-0.10 |
| Tungsten | 3.0-3.7 |
| Molybdenum | 1.80-2.00 |
| Carbon | 0.03-0.10 |
| Boron | 0.001-0.007 |
| Zirconium | 0.001-0.005 |
| Hafnium | 0.001-0.005 |
| Sulfur | 0.0-0.003 |
| Nitrogen | 0.001-0.007 |
| Oxygen | 0.003-0.010 |
| Nickel | Remainder |

The development of this alloy focused on identifying an effective nickel-base alloy free of expensive or overly reactive alloy additions, such that the alloy would be suitable for casting directionally solidified as well as equiaxed components. Initially seven chemistries were produced in directionally solidified cast slabs.

One area addressed during alloy development that is important with respect to the functionality of the alloy was its structural stability. Alloys undergo complex, solid phase reactions during service that can lead to the precipitation of embrittling phases. Controlling the alloy chemistry so as to negate the formation of these topologically close packed phases (TCP) can be achieved with some success by calculating the average electron vacancy per alloy atom, a value termed $N_{v3}$. The structural stability of an alloy is generally calculated according to the equation:

$$N_{V_3} = \sum_{i=1}^{n} m_i(N_v)_i$$

per SAE AS 5491 Rev. B. The higher the $N_{v3}$, the less stable the alloy and more susceptible it is to TCP structures. Prior studies have shown, that even for the most stable alloys of this type, TCP phases can form if the $N_{v3}$>2.45 to 2.49. Some commercial alloys such as Rene 80 and Inconnel 738 become unstable if the $N_{v3}$>2.32 to 2.38.

For the seven chemistries previously mentioned, the stability data is listed below in Table 2. As it will be shown, depending on the form of the casting, the metallurgical stability factor, or structural stability, of the alloy ranges from 2.22-2.40.

TABLE 2

Stability of the First Round of Alloys.

| Alloy | Amount of TCP Phases Present After 1000 hours at 1400 F.° | Amount of TCP Phases Present After 1000 hours at 1600 F.° | $Nv_3$ |
|---|---|---|---|
| 1 | None | Very Limited | 2.19 |
| 2 | None | None | 2.31 |
| 3 | Very Limited | Limited | 2.38 |
| 4 | None | None | 2.16 |
| 5 | Very Limited | Very Limited | 2.26 |
| 6 | None | None | 2.17 |
| 7 | None | Limited | 2.28 |

Even though alloys 5 and 6 did not exceed the $N_{v3}$ value of 2.32 where TCP phases are known to form, further review of specimens did reveal slight instabilities. Alloy 2, having a $N_{v3}$ value of 2.31 showed the best results with respect to structural stability while showing no indications of TCP phases.

In order to increase the mechanical properties of the nickel-based alloy, it is necessary to heat treat the alloy. To heat treat a precipitation strengthened alloy such as a nickel base alloy of the present invention, one must first heat the alloy to a temperature close to the γ' solvus, the temperature above which the main strengthening phase γ' dissolves. This is commonly referred to as solutioning heat treatment. Subsequent exposure to a lower aging temperature will cause the strengthening γ' phase to precipitate in a manner that will increase mechanical properties. The strength of the alloy increases with the amount of γ'. Its distribution and lattice parameter are also factors that effect the degree of strength that can be imparted through γ' precipitation.

The heat treatment window, the difference between the solvus and solidus (temperature where melting starts) is greatly increased in the present invention. It is in this window in which the solutioning heat treatment must be performed in order to safely treat the part without it melting. Relatively small changes in amounts of Aluminum, Titanium, and Tantalum can cause rather large changes in γ' solvus. If the alloy contains higher levels of Aluminum, Titanium, or Tantalum, then the γ' solvus temperature increases, thereby decreasing the heat treatment window. In order to determine the γ' solvus and solidus temperatures, differential thermal analyses (DTA) were performed. As one skilled in the art of materials engineering will understand, a DTA measures the difference in temperature between a sample and a thermally inert reference as the temperature is raised. The plot of this differential provides information on reactions taking place in the sample, including phase transitions, melting points, and crystallization. Some typical results of these analyses are shown below in Table 3.

TABLE 3

Heat Treatment Characteristics

| Alloy | γ'Solvus F.° | Solidus F.° | Heat Treatment Window F.° | Liquidus F.° |
|---|---|---|---|---|
| 2 | 2190 | 2343 | 153 | 2462 |
| 3 | 2188 | 2331 | 143 | 2448 |
| 7 | 2192 | 2327 | 135 | 2448 |

As it can be seen from the data above, the heat treatment window for Alloy 2, the most structurally stable of the alloys, also had a large heat treatment window, approximately 150 degrees F. Depending on the alloy composition, the heat treatment window can range from 120-160 degrees F. Such a large window indicates that the alloy can be heat treated safely under production conditions, without encountering the possibility of melting. This is especially critical, because often times heat treating large parts in large batches cannot be done with very accurate temperature control, often times varying as much as +/−25 degrees F.

Another benefit of heat treating the alloy of the present invention is with respect to its tensile and creep rupture properties. It has been determined that no appreciable benefit is realized by solution heat treating the present invention alloy at higher temperatures or subjecting it to more complex aging treatments, as is the case for other high-temperature nickel-based alloys. The alloys developed through the present invention were heat treated by solutioning at 2050 deg. F.+/−25 deg. F. for 2 hours+/−15 minutes, followed by a cooling gas quench to below 1100 deg. F. The quenching preferably occurs in a gas environment selected from the group comprising Argon, Helium, and Hydrogen. The alloys were then elevated to 1975 deg. F.+/−25 deg. F. and aged for 4 hours+/−15 minutes followed by a gas quench cooling back to below 1100 deg. F. Finally, the alloy is elevated to 1550 deg. F.+/−25 deg. F. and stabilized for 24 hours+/−30 minutes followed by a cooling to below 1100 deg. F., but most likely a room temperature. This heat treat cycle occurs at a relatively low temperature and involves fewer cycles, compared to those of other well-known alloys, thereby making this cycle a very economical heat treatment cycle. This is better understood by comparing the heat treat cycles disclosed herein to those of other similar alloys as shown in Table 4 below.

TABLE 4

Heat Treatment Requirements of Some Commercial Alloys

| Alloy | Present Invention | GTD 404 | CM 247 LC |
|---|---|---|---|
| Applicable Patent | | U.S. Pat. No. 6,908,518 | U.S. Pat. No. 4,461,659 |
| Heat Treatment | 2 hours, 2050° F. + 4 hours 1975° F. + 24 hours 1550° F. | Heat to 1400° F. for 10 minutes + heat to 2225° F. hold 8 hours + heat to 2230° F. hold 4 hours + heat to 2280° F. hold 2 hours. The slow heating and cooling rates stipulated add further furnace time. | 2 hours 2250° F. + 2 hours 2300° F. + 5 hours 2174° F. + 4 hours 1976° F. + 20 hours 1600° F. |

Depending on the type of gas turbine component being cast, the timing of the heat treat cycles may vary. For example, if a gas turbine blade or vane is to be coated with a thermal barrier coating (TBC) for additional protection from high operating temperatures, then the second and third steps in the heat treating process may occur after the TBC has been applied. The step of elevating the alloy to 1975 deg. F.+/−25 deg. F. and holding for 4 hours also serves to treat the coating as part of the coating process.

Another important feature of the present invention, is its density. As one skilled in the art of gas turbine airfoils will understand, the longitudinal stress on an airfoil is proportional to the density squared, or [stress $\sigma\alpha$ (density $\rho)^2$]. That is, the lower the alloy density used to produce the airfoil, the lower longitudinal stresses exhibited by the airfoil.

Specific densities for alloy 2 were both calculated and measured from sample castings. To more precisely calculate the density in this particular chemistry range, an equation has been developed. This equation is not sensitive to Cobalt and Chromium levels and is defined as:

$$D=0.307667639+(\%\ Mo)(0.000452137)+(\%\ W)(0.001737591)-(\%\ Al)(0.004497133)-(\%\ Ti)(0.001240936)+(\%\ Ta)(0.002133375)$$

with % Mo equaling the percentage by weight of Molybdenum, % W equaling the percentage by weight of Tungsten, % Al equaling the percentage by weight of Aluminum, % Ti equaling the percentage by weight of Titanium, and % Ta equaling the percentage by weight of Tantalum.

The degree of fit of the equation is excellent as can be seen by comparing measured densities of the sample casting to the calculated densities as shown in Table 5 below.

TABLE 5

Density of Experimental Alloys

| | Cr | Co | Mo | W | Al | Ti | Ta | Measured Density Lbs/in$^3$ | Calculated Density Lbs/in$^3$ |
|---|---|---|---|---|---|---|---|---|---|
| Alloy 2 | 12 | 12 | 1.9 | 5 | 3.82 | 3.5 | 3 | 0.30259 | 0.30209 |
| Alloy 3 | 12 | 10 | 2.5 | 5.45 | 3.72 | 3.5 | 4 | 0.30552 | 0.30572 |
| Alloy 7 | 12 | 12.1 | 1.5 | 3.8 | 3.06 | 4.95 | 2.9 | 0.30129 | 0.30123 |
| Alloy 1 | 12.5 | 9 | 1.9 | 3.9 | 3.6 | 3.5 | 2.9 | 0.30068 | 0.30095 |
| Alloy 2* | 11.9 | 12 | 1.9 | 4.8 | 3.5 | 3.5 | 2.9 | 0.30270 | 0.30297 |
| Alloy 4* | 10.1 | 11.9 | 2.5 | 5.3 | 3.1 | 4.1 | 3.4 | 0.30604 | 0.30623 |
| Alloy 5* | 12.1 | 9.5 | 3 | 4.4 | 2.8 | 4.6 | 3.4 | 0.30591 | 0.30562 |
| Alloy 6* | 10.9 | 11.9 | 2.5 | 4.4 | 3.4 | 3.6 | 3.4 | 0.30414 | 0.30393 |
| Alloy 2A | 12.1 | 12 | 1.5 | 3.3 | 3.6 | 4.6 | 2.5 | 0.29756 | 0.29751 |
| Alloy 2B | 12.1 | 12 | 1.5 | 3 | 3.7 | 4.1 | 2.9 | 0.29832 | 0.29801 |
| Alloy 2C | 11.9 | 11.9 | 1.9 | 3.5 | 3.3 | 5.1 | 2.4 | 0.29846 | 0.29855 |
| Alloy 2D | 12 | 11.9 | 2 | 3 | 3.5 | 4.6 | 2.9 | 0.29818 | 0.29852 |

*Cast using an alternate supplier

As previously discussed, the density of this new alloy is significant because of the lower inherent operating stresses. The density of the alloy in the present invention is less than or equal to 0.30 lb./in$^3$ The lower density level of this alloy can be better appreciated when compared to other alloys commonly used in gas turbine applications as shown in Table 6 below.

TABLE 6

Densities of Various Gas Turbine Alloys

| ALLOY | Density gm/cm3 | Density Lbs/in3 |
|---|---|---|
| PWA 1484 | 8.8 | 0.323 |
| PWA 1480 | 8.7 | 0.314 |
| CMSX-4 | 8.7 | 0.314 |
| Rene N5 | 8.6 | 0.312 |
| CM 247 LC | 8.54 | 0.308 |
| GTD 404 | 8.4 | 0.307 |
| GTD 111 | 8.3 | 0.300 |
| Alloy 2C | 8.24 | 0.298 |

Another important factor regarding alloy density pertains to the resulting component weight and frequency. The lower the density, the lower the weight of the component. For a turbine blade which is rotating, the blade attachment pulls on a disk, while the blade is being held in the disk. This pull is a function of the blade weight. A lower weight blade will have less pull on the disk and as a result have lower attachment stresses.

The density also affects the natural frequency of an airfoil, whether it be a blade or a vane. As one skilled in the art will understand, the natural frequency of an airfoil is critical in that it must remain out of the critical frequency of the engine (60 Hz for an engine operating at 3600 revolutions per minute). Not only are the airfoils intended to be outside the operating frequency of the engine (60 Hz in this example), but also any order thereof (i.e. 120 Hz, 180 Hz). Present turbine blades fabricated from an alloy having a higher density have a natural frequency just above the frequency of the engine. If a blade or vane resides at the natural frequency of the engine, or any order thereof for a long period of time, failure of the blade can occur due to high cycle fatigue. Fabricating the turbine blades/vanes from a lower density alloy, not only reduces component weight, and attachment stress for blades, but also raises its natural frequency, which moves the blade or vane frequency further away from the engine frequency, thereby reducing the chance of high cycle fatigue failure.

Mechanical properties for two data points for the first round of alloys are shown below in Tables 7 and 8. Table 7 represents ultimate tensile strength (UTS) data and yield strength (YS) data at temperatures of 800 deg. F. and 1400 deg. F., while Table 8 represents creep-rupture data at 1400 deg. F. Each of these tables also include data referring to a "baseline." Comparisons are made in the following tables and figures between the alloys developed and a baseline alloy and GTD-111. The baseline is an alloy presently used by the assignee in certain airfoil productions, with the baseline having properties similar to that of GTD-111.

As previously discussed, a goal of this development program is to produce a stable alloy, having improved strength, that has improved castability, and lower manufacturing costs. Referring to Table 7, two casting trials of alloy 2 are highlighted as well as a baseline alloy. As it can be seen from the data, alloy 2 (both casting trials) has a UTS within approximately 3% of the baseline alloy at the lower temperature 800 deg. F., while having a higher YS. While alloy 7 has a greater UTS, it has a smaller heat treat window (135 deg. F. vs 153 deg. F. for alloy 2). Alloy 3 also has a smaller heat treat window than alloy 2 and has a lower UTS. Shortcomings in the other development alloys become apparent at higher operating temperatures.

At typical turbine operating temperatures, closer to 1400 deg. F., alloy 2 (both casting trials) have a UTS and YS greater than the baseline. Also, as previously discussed, alloy 2 was completely structurally stable and had the largest heat treat window, lending itself to better manufacturing conditions. As it can be seen, the other alloys at 1400 deg. F. either did not have the strength of alloy 2 or began to exhibit structural instabilities (TCP phases), as previously discussed in Table 2 and reproduced below.

From this and other data, it was determined that alloy 2 was the preferred composition that provided the necessary strength, structural stability, and allowed for a more manufacturing-friendly process.

Further analysis and development of alloy 2 was then conducted to determine the final composition. More specifically, four small heats (30 lb heats) were cast as directionally solidified slabs and evaluated. These size heats were selected as being more representative of sizes and weights for typical gas turbine casting applications. For these heats, the electron vacancy number, $N_{v3}$, ranged from 2.220-2.280. The resulting chemistries of these four alloys is shown in the following Table 9.

TABLE 7

Alloy Casting Trial Mechanical Properties

| Alloy | H/T | Orient | Temp (F.) | UTS (KSI) | 0.2% YS (KSI) | % Elong. | ROA % | Stability | HT Window | TCP Phases 1400 | TCP Phases 1600 |
|---|---|---|---|---|---|---|---|---|---|---|---|
| Baseline | A | Long | 800 | 169.1 | 126.9 | 6.6 | 8.6 | | | | |
| PCC1 | A | Long | 800 | 161.3 | 130 | 7.7 | 13.1 | | | | |
| CC2 | A | Long | 800 | 164.7 | 127.3 | 10.5 | 17.2 | | 153 | | |
| PCC2 | A | Long | 800 | 160.2 | 133.7 | 6.6 | 12.4 | | | | |
| CC3 | A | Long | 800 | 155.8 | 132.3 | 6.6 | 9.3 | | 143 | | |
| PCC4 | A | Long | 800 | 164 | 132.8 | 7.3 | 10.9 | | | | |
| PCC5 | A | Long | 800 | 172.1 | 146.6 | 3.6 | 7.4 | | | | |
| PCC6 | A | Long | 800 | 165.5 | 135.8 | 8.7 | 12.7 | | | | |
| CC7 | A | Long | 800 | 173.4 | 134.8 | 5 | 9.7 | | 135 | | |
| Baseline | A | Long | 1400 | 151.8 | 121.3 | 16.4 | 23.2 | | | | |
| PCC1 | A | Long | 1400 | 158.5 | 135.3 | 6.9 | 10.4 | 2.19 | | None | Very Limited |
| CC2 | A | Long | 1400 | 164 | 139.7 | 20.8 | 33.3 | 2.31 | 153 | None | None |
| PCC2 | A | Long | 1400 | 162.2 | 140.4 | 7.9 | 11.6 | | | | |
| CC3 | A | Long | 1400 | 163.6 | 127.5 | 14.3 | 20.4 | 2.38 | 143 | Very Limited | Limited |
| PCC4 | A | Long | 1400 | 161.9 | 141.1 | 7 | 9.7 | 2.16 | | None | None |
| PCC5 | A | Long | 1400 | 167.5 | NA | 12.4 | 16.8 | 2.26 | | Very Limited | Very Limited |
| PCC6 | A | Long | 1400 | 159 | 136.3 | 5.1 | 8.2 | 2.17 | | None | None |
| CC7 | A | Long | 1400 | 155.9 | 129.2 | 21 | 38.2 | 2.28 | 135 | None | Limited |

In addition to strength of the various alloys, another measure of alloy capability is creep-rupture (see Table 8 below). Creep is a plastic deformation caused by slip occurring along crystallographic directions due to constant load/stress applied at an elevated temperature. Creep is typically measured in percent deformation and the number of hours necessary under the loading and temperature to cause the deformation. From the data in Table 8, it can be seen that all of the alloys showed improvement with respect to creep life and the number of hours for 0.5%, 1%, 2%, and 5% creep deformation. Although alloy 3 showed better creep life than alloy 2, alloy 3 had other shortcomings with respect to heat treat windows and structural stability, as shown in Table 7.

TABLE 9

Chemistries of Alloy 2 Variations

| Property | Alloy 2A | Alloy 2B | Alloy 2C | Alloy 2D |
|---|---|---|---|---|
| Al | 3.59 | 3.63 | 3.31 | 3.57 |
| Ti | 4.53 | 4.02 | 4.98 | 4.50 |
| Ta | 2.59 | 3.00 | 2.54 | 3.05 |
| Cr | 11.97 | 11.93 | 11.78 | 11.87 |
| Co | 12.04 | 12.04 | 11.96 | 11.96 |
| W | 3.40 | 3.08 | 3.65 | 3.09 |
| Mo | 1.46 | 1.44 | 1.89 | 1.98 |
| C | 0.076 | 0.066 | 0.072 | 0.066 |

TABLE 8

Alloy Casting Trials Creep Rupture Data

| Alloy | HT | Orient | Temp ° F. | Stress KSI | Life Hours Hours | Hours to Creep 0.50% | 1% | 2% | 5% |
|---|---|---|---|---|---|---|---|---|---|
| Baseline | A | L | 1400 | 85 | 301.9 | 9 | 32.25 | 103.5 | 221.5 |
| 1 | A | L | 1400 | 85 | 508.2 | 42.7 | 129.4 | 266.7 | 466 |
| PCC2 | A | L | 1400 | 85 | 659.2 | 53.6 | 196.4 | 452.4 | power |
| CC2 | A | L | 1400 | 85 | 1317.9 | 58 | 211.3 | 473 | 912.5 |
| 3 | A | L | 1400 | 85 | 1255.2 | 101.7 | 303.2 | 637.95 | 1169.5 |
| 4 | A | L | 1400 | 85 | 658.7 | 66.6 | 214.2 | 551.5 | fail |
| 5 | A | L | 1400 | 85 | 613 | 15.75 | 98.25 | 299.5 | power |
| 6 | A | L | 1400 | 85 | 517.7 | 34.7 | 123 | 312.2 | power |
| 7 | A | L | 1400 | 85 | 511.2 | 19.7 | 66.9 | 192.4 | 384.2 |

TABLE 9-continued

| Chemistries of Alloy 2 Variations | | | | |
|---|---|---|---|---|
| Property | Alloy 2A | Alloy 2B | Alloy 2C | Alloy 2D |
| B | 0.012 | 0.011 | 0.010 | 0.010 |
| Zr | <10 ppm | <10 ppm | <10 ppm | <10 ppm |
| S | 6 ppm | 7 ppm | 4 ppm | 7 ppm |
| N | 12 ppm | 19 ppm | 8 ppm | 16 ppm |
| O | 9 ppm | 6 ppm | 8 ppm | 9 ppm |
| P | 8 ppm | 10 ppm | 8 ppm | 9 ppm |
| Re | <0.10 | <0.10 | <0.10 | <0.10 |
| V | <0.10 | <0.05 | <0.10 | <0.05 |
| $Nv_3$ | 2.270 | 2.220 | 2.280 | 2.270 |

Figure 2:
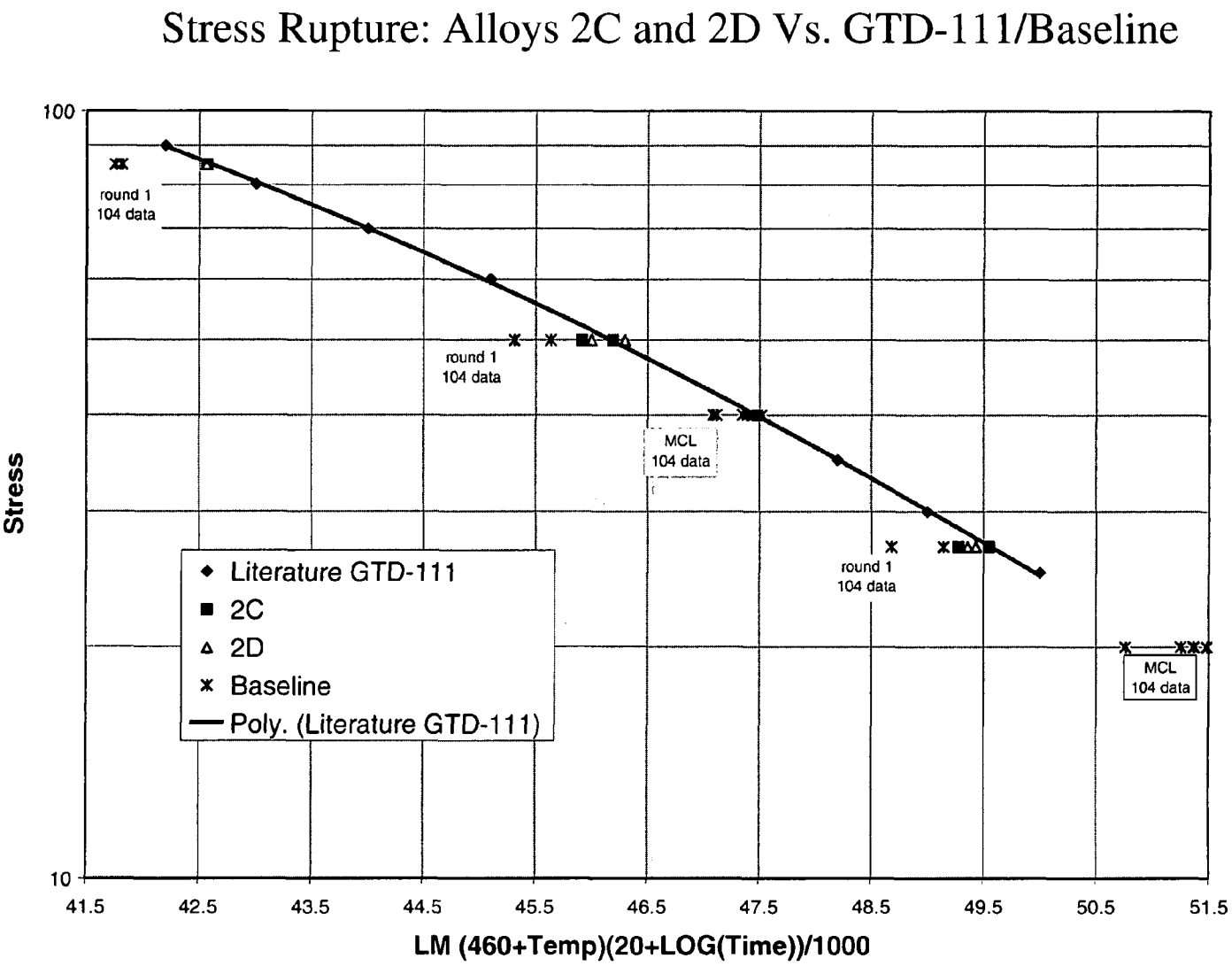
FIG. 2 is a chart depicting stress rupture versus a normalized time and temperature parameter for an alloy embodiment of the present invention compared to prior art alloys.

Mechanical properties of alloys 2A-2D were compared to a baseline to determine a preferred alloy. Referring to Table 10 it can be seen that alloy 2C provided improved YS and UTS at 800 deg. F. over the baseline as well as improved YS in the transverse direction at 1400 deg. F. A plot of alloy 2C capability vs. GTD-111 is shown in FIG. 1. Stress rupture data for alloys 2C and 2D are compared to a baseline alloy and GTD-111 in FIG. 2. From this chart it can be seen that alloy 2C has greater stress rupture life than that of the baseline and in that way is similar to that of GTD-111.

TABLE 10

| Tensile Properties of The Experimental Alloy 2 Variations of this Invention Compared to GTD 111 DS | | | | | |
|---|---|---|---|---|---|
| Property | Alloy 2A | Alloy2B | Alloy 2C | Alloy 2D | GTD 111 DS |
| Longitudinal | | | | | |
| 800° F. YS ksi | 125 | 124 | 134 | 135 | 130 |
| 800° F. UTS, ksi | 177 | 180 | 179 | 179 | 170 |
| 800° F. El % | 7 | 7 | 5 | 5 | |
| 800° F. RA % | 14 | 15 | 13 | 13 | |
| Longitudinal | | | | | |
| 1400° F. YS ksi | 130 | 125 | 131 | 132 | 132 |
| 1400° F. UTS, ksi | 148 | 143 | 148 | 150 | 152 |
| 1400° F. El % | 8 | 7 | 10 | 8 | |
| 1400° F. RA % | 22 | 20 | 23 | 20 | |
| Transverse | | | | | |
| 1400° F. YS ksi | 114 | 109 | 119 | 113 | 104 |
| 1400° F. UTS, ksi | 133 | 131 | 136 | 133 | 140 |
| 1400° F. El % | 2 | 2 | 3 | 3 | |
| 1400° F. RA % | 5 | 6 | 5 | 8 | |
| Longitudinal | | | | | |
| 1600° F. YS ksi | 77 | 70 | 82 | 78 | 84 |
| 1600° F. UTS, ksi | 100 | 93 | 103 | 103 | 104 |
| 1600° F. El % | 16 | 29 | 13 | 12 | |
| 1600° F. RA % | 36 | 43 | 37 | 38 | |

Having determined that alloy 2 is the preferred alloy, and more particularly, that Alloy 2C is the preferred elemental composition, due to its improved tensile strength at 800 degrees F., it was desirable to verify that production-sized quantities of the alloy can be produced in both directionally solidified (DS) and conventional, or equiaxed, castings. To evaluate production sized castings, two 380 lb. master alloy heats were produced. As one skilled in the art of investment casting will understand, in order to cast a nickel-based alloy such as the present invention with different solidification techniques, DS versus equiaxed, it is necessary to modify the carbon content. Specifically, an equiaxed casting requires a greater carbon content, approximately 0.07-0.10%, whereas a DS casting only requires approximately 0.03-0.06%. For the sample heats cast in each configuration, the chemical analyses are shown below in Table 11.

TABLE 11

| Chemical Analyses of 400 lb Production Heats | | |
|---|---|---|
| Property | 2C-1 DS | 2C-1 Conventional. |
| Al | 3.54 | 3.56 |
| Ti | 5.08 | 5.1 |
| Ta | 2.5 | 2.5 |
| Cr | 12.0 | 12.2 |
| Co | 12.2 | 12.1 |
| W | 3.5 | 3.5 |
| Mo | 1.9 | 1.9 |
| C | 0.050 | 0.097 |
| B | 0.015 | 0.015 |
| Zr | <10 ppm | <ppm |
| S | 1 ppm | 1 ppm |
| N | 1 ppm | 4 ppm |
| O | 6 ppm | 6 ppm |
| P | 7 ppm | 6 ppm |
| Re | <0.10 | <0.10 |
| V | <0.005 | <0.005 |
| $Nv_3$ | 2.400 | 2.390 |

Figure 3:
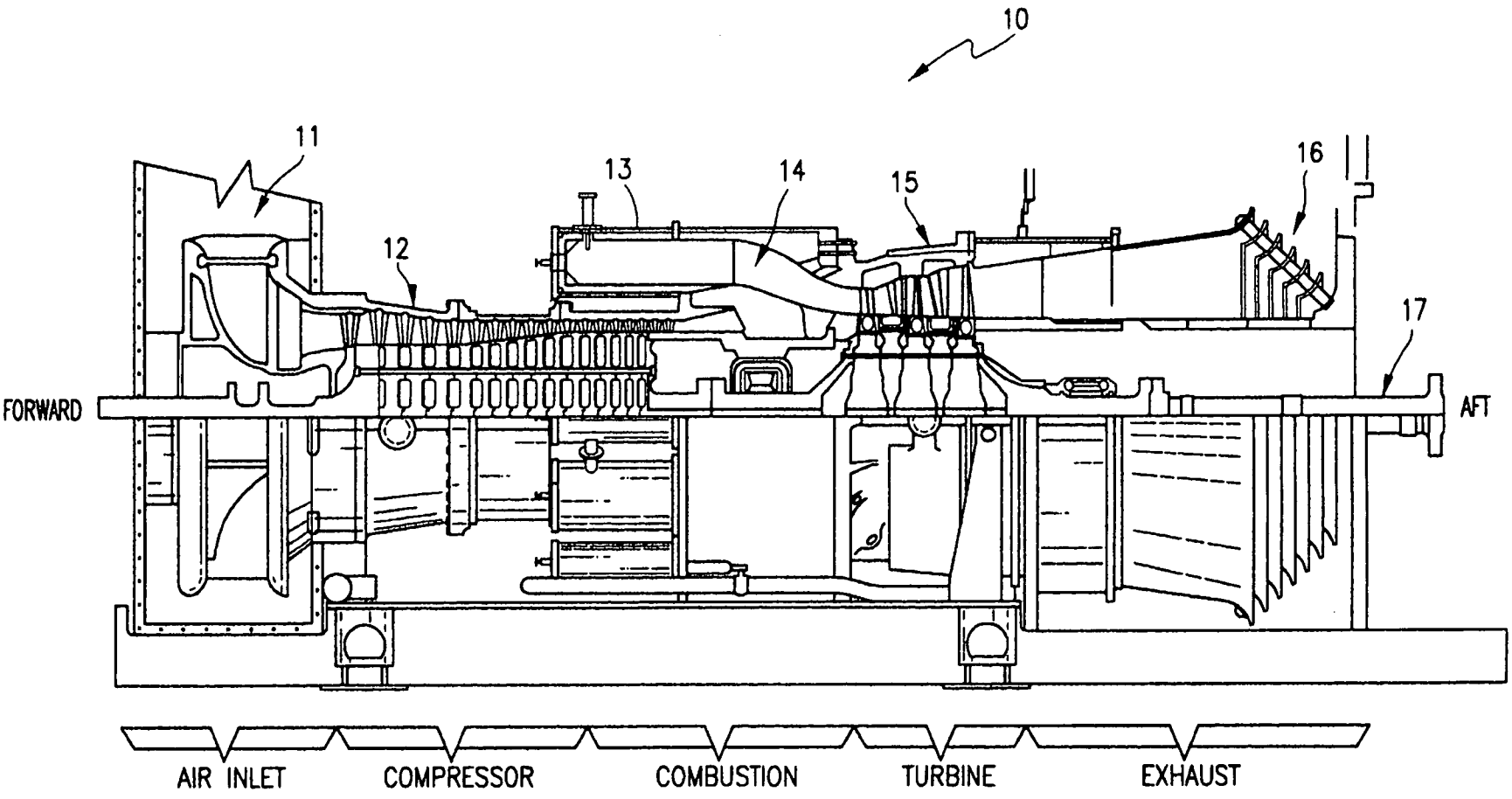
FIG. 3 is a cross section of a gas turbine engine identifying the location where buckets and nozzles in accordance with the present invention are present.
Figure 4:
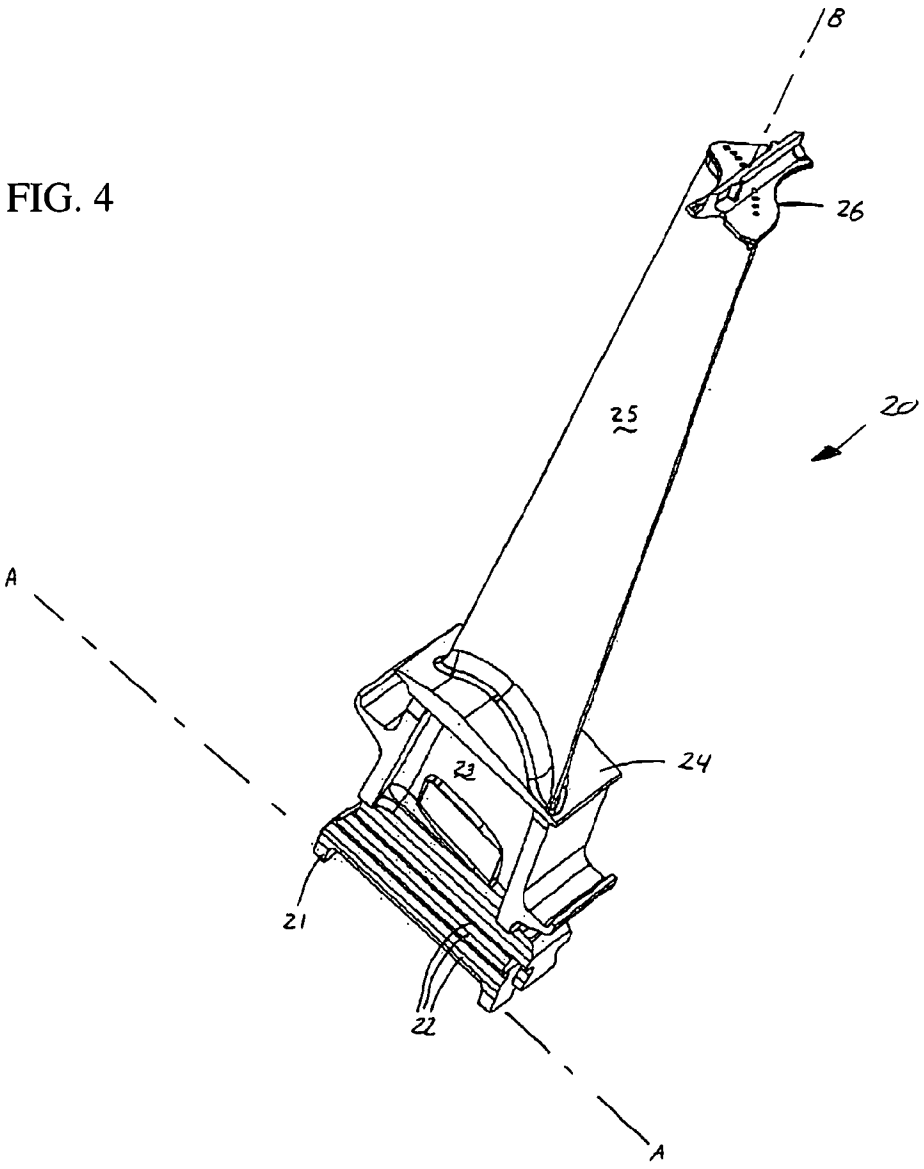
FIG. 4 is a perspective view of a bucket formed from the superalloy in accordance with an embodiment of the present invention.

Having concluded that Alloy 2C could be successfully cast in both DS and equiaxed styles, the next step in the alloy development was to shift from casting trial heats, to casting trial gas turbine components. A cross section of a typical gas turbine engine is shown in FIG. 3 with each section of the engine noted. Specifically, the gas turbine engine 10 includes an inlet 11 for receiving air and an axial, a multi-stage compressor 12 which compresses the air from the inlet 11. The compressed air is mixed with fuel in one or more combustors 13 and ignited to form a hot gases that are directed through one or more transition ducts 14. The hot gases are then directed through a turbine 15 which is coupled to the compressor 12 by a shaft 17. Hot gases are exhausted from the turbine 15 through an outlet 16. For Alloy 2C, two blades from the turbine section compatible with each the General Electric Frame 7FA $2^{nd}$ stage and $3^{rd}$ stage turbine were cast. The $2^{nd}$ stage blades are approximately 18 inches long and each weigh approximately 19 lbs. A diagram of this type of gas turbine blade is shown in FIG. 4. Specifically, gas turbine blade 20 includes an attachment 21 having a plurality of serrations 22 for securing the blade in a disk (not shown). Extending radially outward from the attachment 21 is a neck 23 and platform 24. Extending radially outward from the platform 24 is an airfoil 25 and, for an embodiment of the present invention, a shroud 26. This blade is typically cast in a directionally solidified manner due to the operating temperatures and stress levels experienced by the blade. It is cast from CM 247, a nickel base alloy having a density higher than that of the alloy disclosed herein, details of which have previously been discussed and are disclosed in U.S. Pat. No. 4,461,659. Average production yield (% of acceptable castings) for this airfoil cast in CM-247 is approximately 80%. Trial castings for this stage turbine blade resulted in a 100% yield. Although the sample size was small, there were no indications that this yield would be any different in a production setting.

Figure 5:
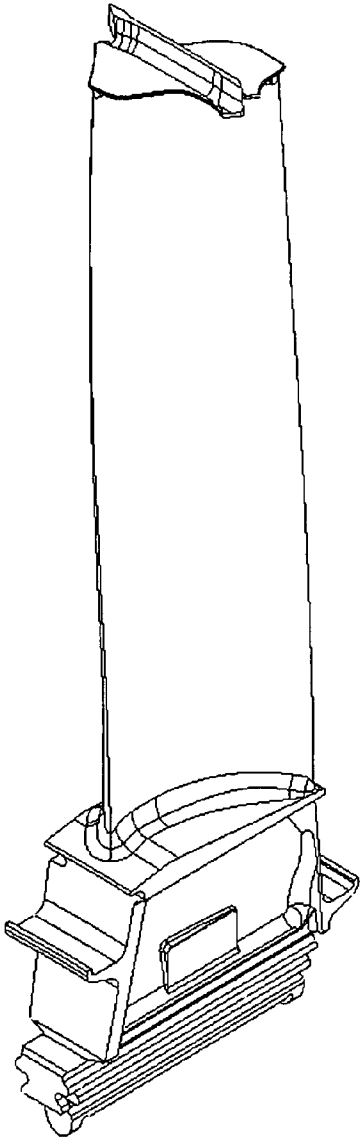
FIG. 5 is a perspective view of an alternate bucket formed from the superalloy in accordance with an embodiment of the present invention.

As for the $3^{rd}$ stage blade, it is approximately 23 inches long and weighs approximately 26 lbs. A diagram of this type of gas turbine blade is shown in FIG. 5. This blade is typically cast in a conventional, or equiaxed, style from CM 247 as well. However, typical yield from this part is only approximately 20% when being cast from CM 247. Utilizing the alloy of the present invention raised the casting yield to 100%.

Although the sample size was small, there were no indications that this yield would be any different in a production setting.

Through additional testing and analysis, slight modifications were made to the composition of alloy 2C to yield a more producible composition as well as to further improve the material capabilities. The resulting composition differs slightly between equiaxed and DS form, but are both covered by the alloy composition listed below in Table 12.

TABLE 12

| Alloy Composition | |
|---|---|
| Element | Weight Percent |
| Aluminum | 3.35-3.65 |
| Titanium | 4.85-5.15 |
| Tantalum | 2.30-2.70 |
| Chromium | 11.50-12.50 |
| Cobalt | 11.50-12.50 |
| Iron | 0.0-0.15 |
| Copper | 0.0-0.10 |
| Tungsten | 3.3-3.7 |
| Molybdenum | 1.70-2.10 |
| Carbon | 0.04-0.12 |
| Boron | 0.010-0.020 |
| Zirconium | 0.0-20 ppm |
| Hafnium | 0.0-0.05 |
| Sulfur | 0.0-0.0012 |
| Nitrogen | 0.0-25 ppm |
| Oxygen | 0.0-10 ppm |
| Nickel | Remainder |

Figure 6:
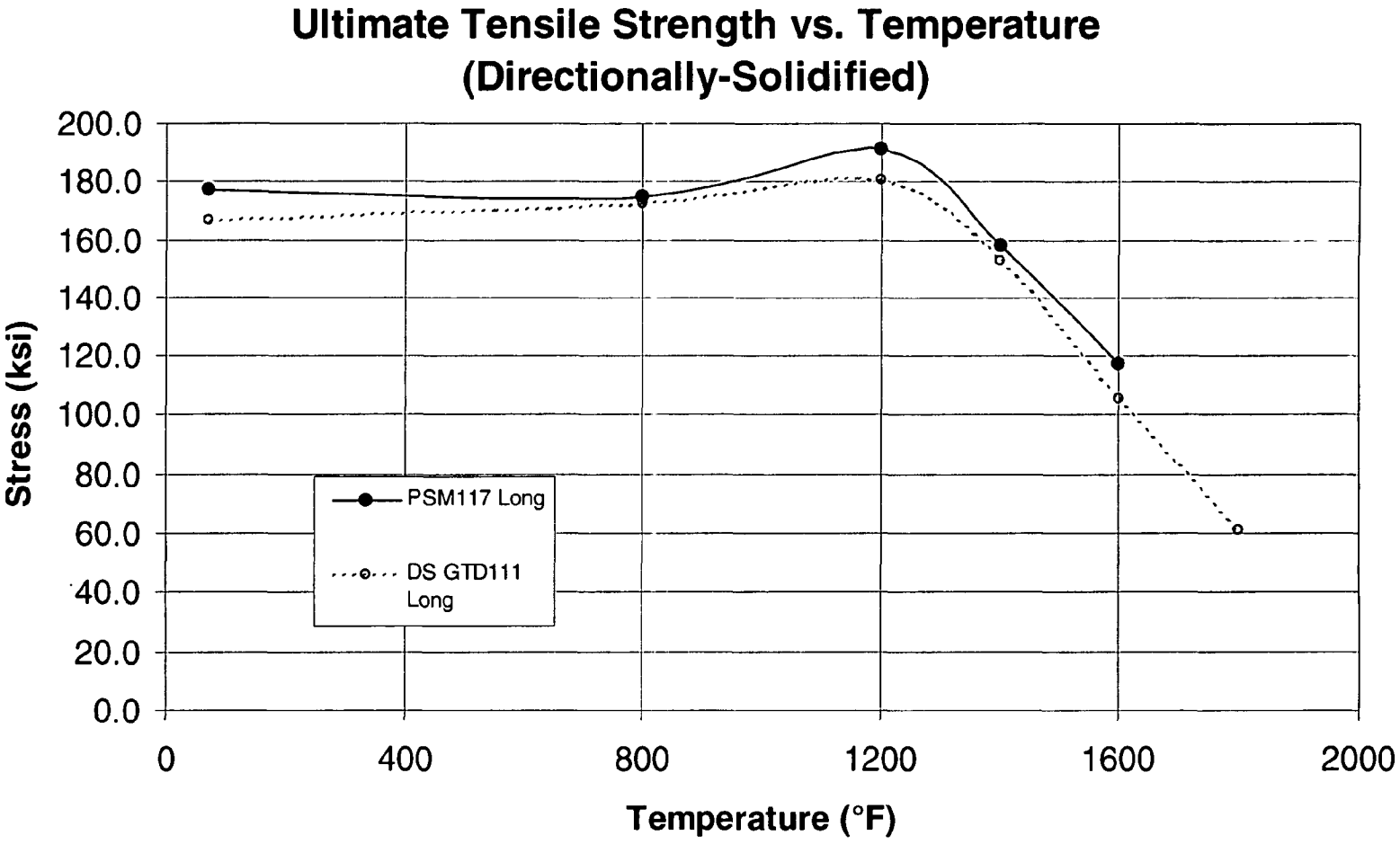
FIG. 6 is a chart depicting ultimate tensile strength versus temperature for a directionally-solidified embodiment of an alloy of the present invention compared to a prior art alloy.
Figure 7:
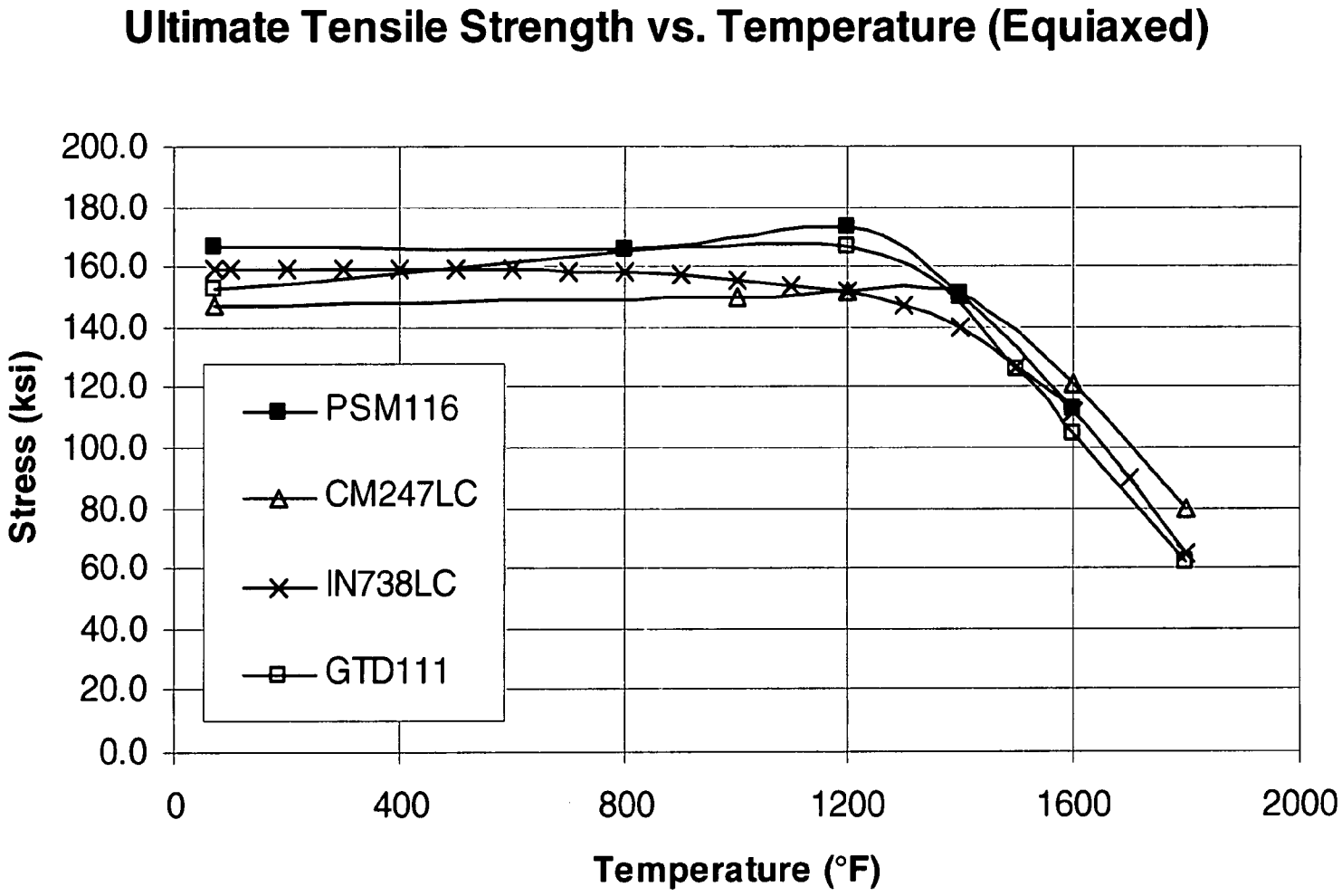
FIG. 7 is a chart depicting ultimate strength versus temperature for an equiaxed embodiment of an alloy of the present invention compared to prior art alloys.

Through such analysis and testing, better understanding of the material capabilities for alloy 2C in both an equiaxed and directionally-solidified form were measured. The equiaxed form of alloy 2C was designated as PSM116 and the DS form of alloy 2C was designated as PSM117. PSM117 was analyzed with respect to both longitudinal and transverse directions. As one skilled in the art will understand, "longitudinal" or "long" refers to along the grain boundaries whereas "transverse" or "trans" is the direction 90 degrees to the grain direction. Modifications made to create the production form of the equiaxed and DS alloy included minor changes in elemental concentrations, some increasing, some decreasing. Upon mechanical testing of production specimens, it was determined that ultimate tensile strength improved over alloy 2C, and the prior art alloy GTD-111. This was true for both equiaxed and DS forms at the upper end of the operating spectrum of a turbine blade, greater than approximately 1200 F (see FIGS. 6 and 7). As can be seen in FIG. 7, the equiaxed form of alloy of the present invention also has improved ultimate tensile strength over a majority of the temperature profile compared to prior art alloys Canon-Muskegon 247 and Inconnel 738.

Figure 8:
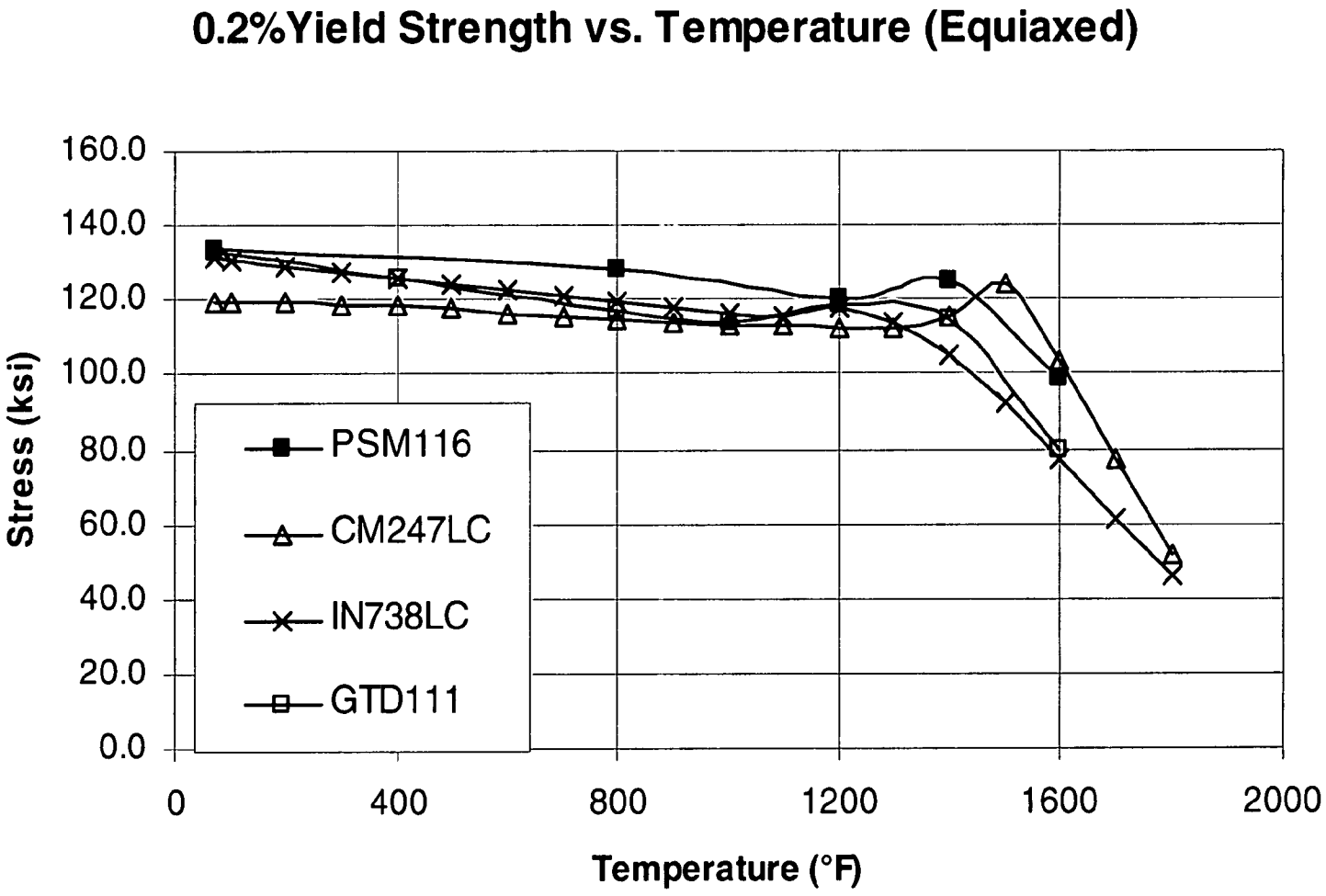
FIG. 8 is a chart depicting yield strength versus temperature for an equiaxed embodiment of an alloy of the present invention compared to prior art alloys.
Figure 9:
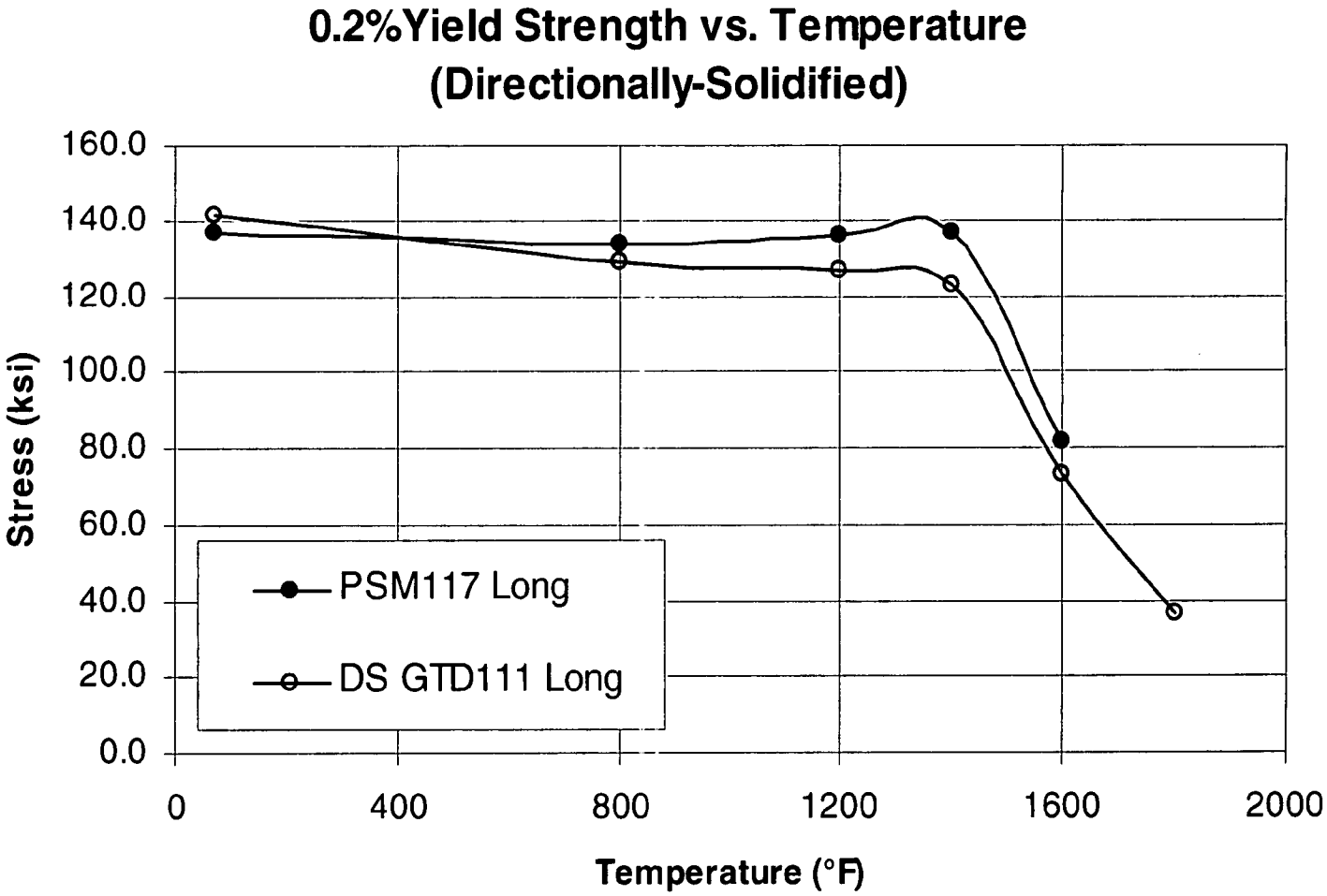
FIG. 9 is a chart depicting yield strength versus temperature for a directionally-solidified embodiment of an alloy of the present invention compared to a prior art alloy.

Furthermore, for the same operating spectrum, yield strength of the equiaxed alloy, PSM116, was also slightly improved over that of alloy 2C, prior art alloys GTD-111, CM-247, and IN-738 (see FIG. 8). Referring to FIG. 9, similar improvements in yield strength compared to prior art alloy GTD-111 can be seen for the DS specimiens of the present invention alloy. These improvements in yield strength and ultimate strength at the upper end of the operating envelope are important since turbine blades fabricated from this alloy tend to operate at these higher temperatures (1200 deg. F. and higher).

Figure 10:
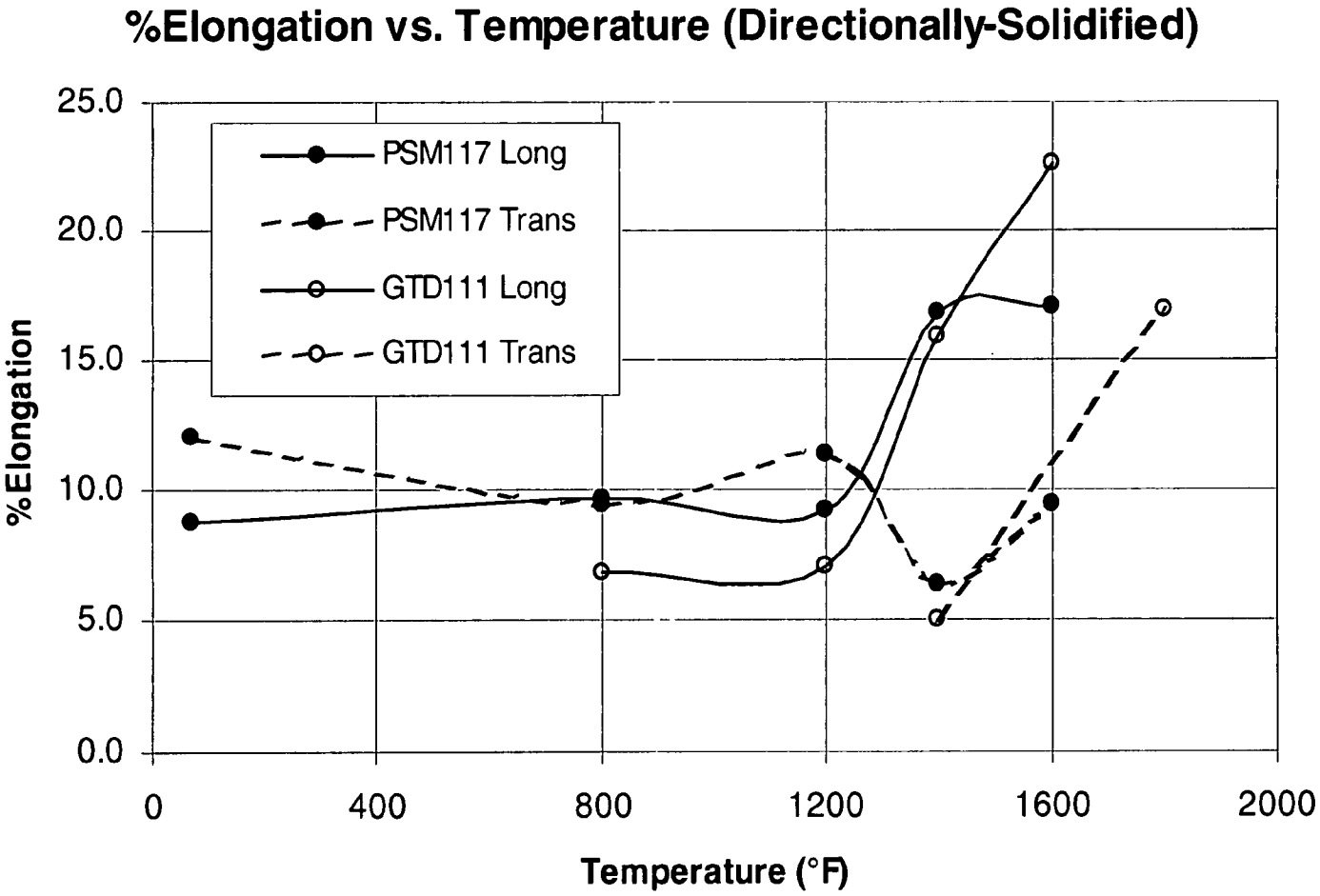
FIG. 10 is a chart depicting material elongation versus temperature for a directionally-solidified embodiment of an alloy of the present invention compared to a prior art alloy.
Figure 11:
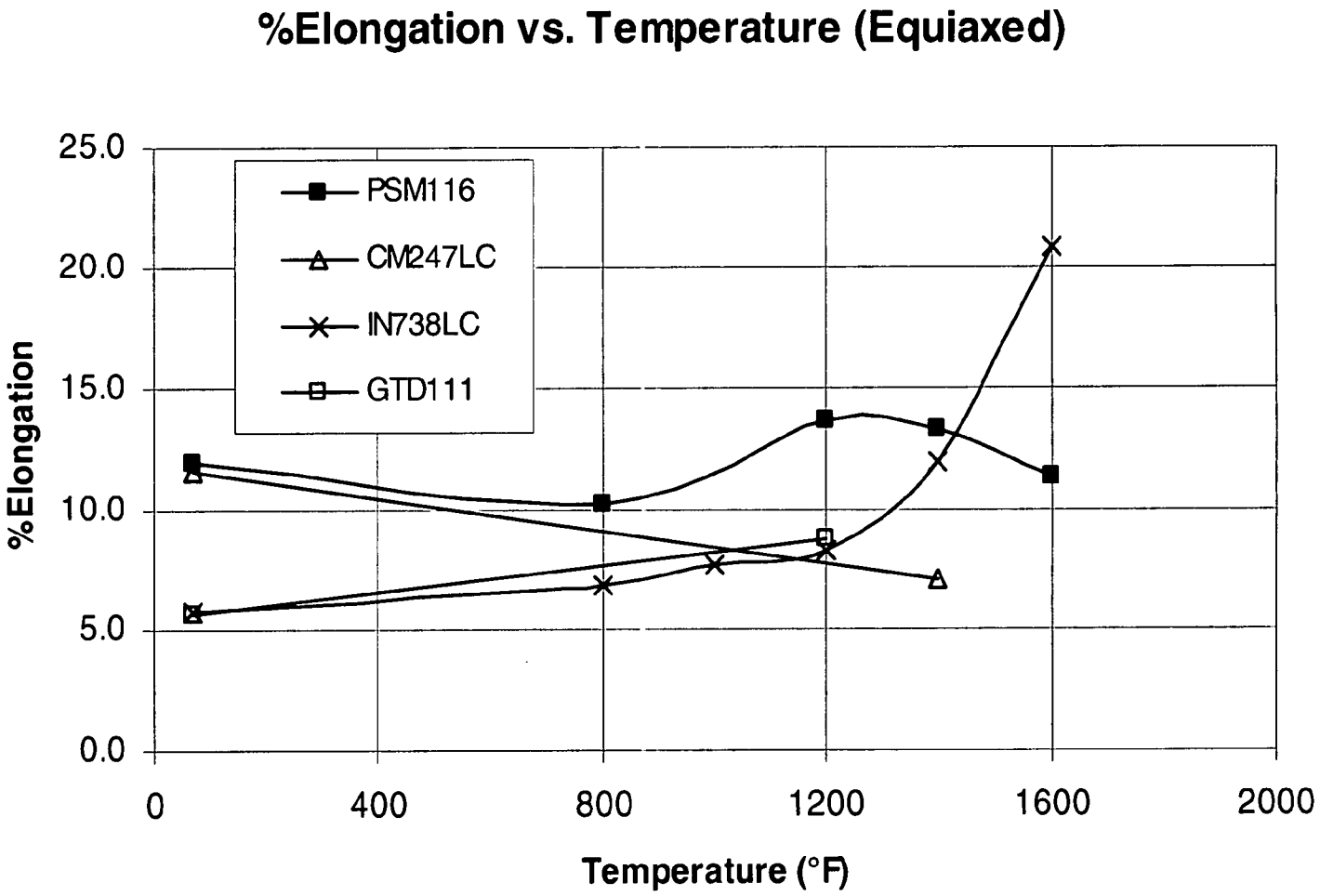
FIG. 11 is a chart depicting material elongation versus temperature for an equiaxed embodiment of an alloy of the present invention compared to prior art alloys.

Referring now to FIGS. 10 and 11, the elongation of the material under elevated temperature is shown respectively for directionally solidified and equiaxed forms of the present invention. In general, for both forms of the alloy, the percent elongation is greater at higher operating temperatures than at lower temperatures. Referring to FIG. 10, the DS form of the alloy has slightly more elongation than that of prior art alloy GTD-111. However, at higher operating temperatures, above approximately 1400 F, the percent elongation of the DS form (PSM117) is less than that of GTD-111. It is this arrangement that is most desirable for gas turbine technology. For turbine blades and vanes which operate at higher temperatures, having smaller amounts of elongation is indicative of a stronger component. With regards to FIG. 11, the percent elongation versus temperature for the equiaxed form of the present invention alloy, PSM116, is shown. The percent elongation is higher for the equiaxed alloy across most of the temperature profile compared to the prior art alloys.

Figure 12:
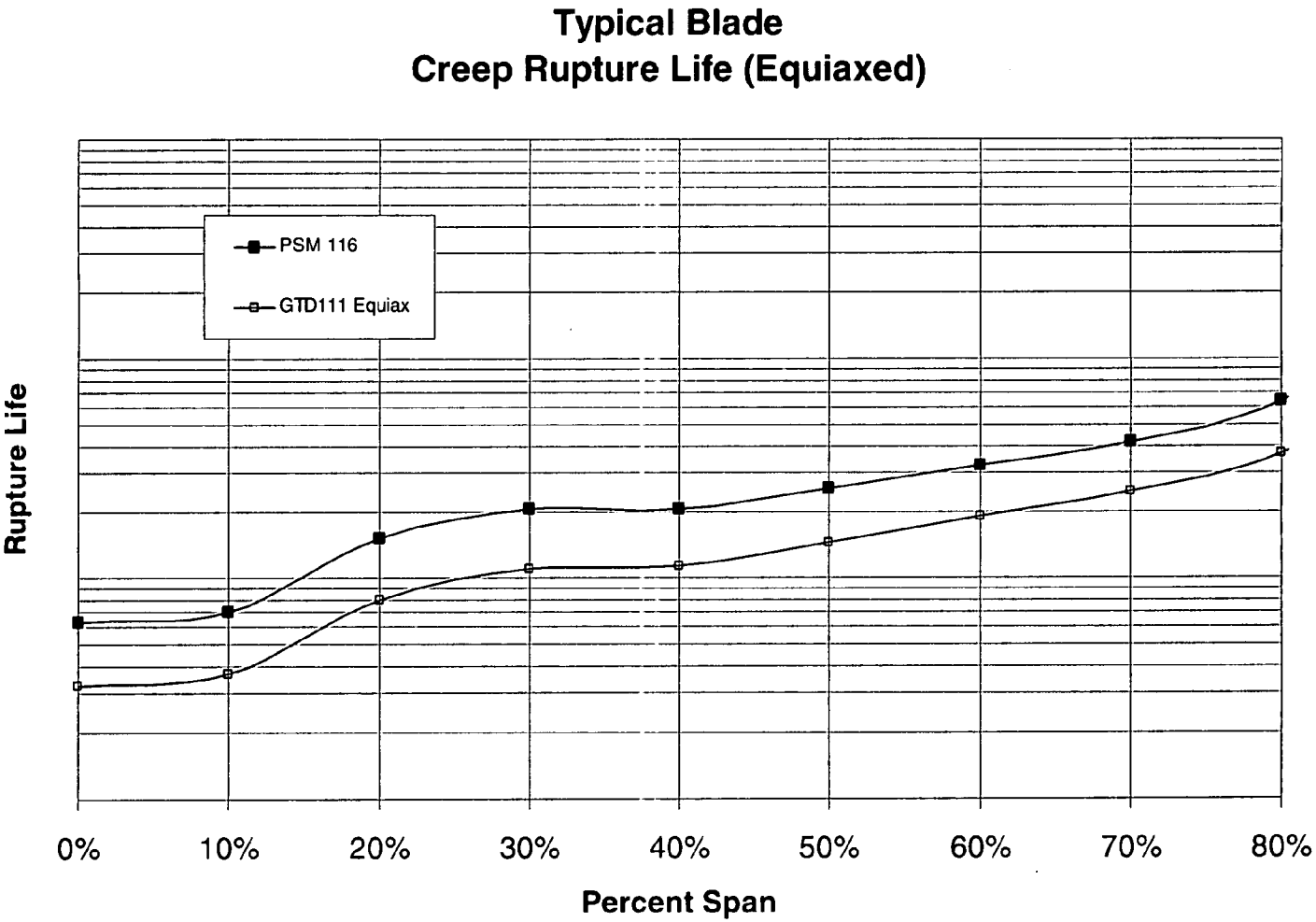
FIG. 12 is a chart depicting creep rupture life of a blade fabricated from the equiaxed embodiment of an alloy of the present invention compared to a prior art alloy.

Referring to FIG. 12, an additional benefit from the alloy of the present invention is shown in terms of creep rupture life over percent span of the blade formed from the alloy. Life of the component is measured in terms of hours until rupture occurs. As it can be seen from FIG. 12, for a given temperature and mechanical load, the equiaxed form of alloy 2C, PSM116, shows improvement in rupture life (non-dimensional scale shown) from the route of a blade formed from the alloy to at least the 80% span location, compared to the equiaxed form of prior art alloy GTD-111.

In addition to the alloy composition being disclosed, a method of making a cast and heat treated article of a nickel-based alloy is disclosed comprising providing the alloy in accordance with the composition levels previously described and subjecting the alloy to the heat treating process previously disclosed.

The present invention has been described in relation to particular embodiments, which are intended in all respects to be illustrative rather than restrictive. Alternative embodiments will become apparent to those of ordinary skill in the art to which the present invention pertains without departing from its scope.

From the foregoing, it will be seen that this invention is one well adapted to attain all the ends and objects set forth above, together with other advantages which are obvious and inherent to the system and method. It will be understood that certain features and sub-combinations are of utility and may be employed without reference to other features and sub-combinations. This is contemplated by and within the scope of the claims.

What is claimed is:

1. A turbine blade casting from nickel-based alloy having a density about 0.30 pounds per cubic inch, suitable for casting lower longitudinally-stressed gas turbine components, the nickel-based alloy comprising the following composition by weight percent:

Aluminum 3.35-3.65
Titanium 5.01-5.15
Tantalum 2.30-2.70
Chromium 12.01-12.5
Cobalt 11.50-12.50
Iron 0.01-0.15
Copper 0.01-0.10
Tungsten 3.3-3.7
Molybdenum 1.70-2.10
Carbon 0.04-0.12
Boron 0.010-0.020
Zirconium 0.01-20 parts per million
Hafnium 0.0-0.05
Sulfur 0.0001-0.0012
Nitrogen 0.1-25 parts per million
Oxygen 0.1-10 parts per million, and
the remainder Nickel and incidental impurities;

wherein the nickel-based alloy measures an ultimate tensile strength increase at the upper end of an operating spectrum of the turbine blade, greater than approximately 1200 degrees F. in both directionally solidified and equiaxed forms.

2. The nickel based alloy of claim 1, wherein the nickel-based alloy is solution heat treated following a process comprising:

elevating said alloy to 2050 deg. F.+/−25 deg. F. and holding for 2 hours +/−15 minutes;

cooling said alloy by gas quench to 1100 deg. F. or below;

elevating said alloy to 1975 deg. F.+/−25 deg. F. and holding for 4 hours +/−15 minutes;

cooling said alloy by gas quench to 1100 deg. F. or below;

elevating said alloy to 1550 deg. F.+/−25 deg. F. and holding for 24 hours +/−30 minutes; and, cooling said alloy to 1100 deg. F. or below.

3. The nickel-based alloy of claim 2, wherein a thermal barrier coating is applied to the alloy prior to the steps of elevating said alloy to 1975 deg. F.+/−25 deg. F. and holding for 4 hours+/−15 minutes, cooling said alloy by gas quench to below 1100 deg. F., elevating said alloy to 1550 deg. F.+/−25 deg. F. and holding for 24 hours+/−30 minutes, and cooling said alloy to below 1100 deg. F.

4. The nickel-based alloy of claim 2, wherein said gas for said cooling is selected from the group comprising Argon, Helium, and Hydrogen.

5. The nickel-based alloy of claim 1, wherein the nickel based alloy comprises:

Aluminum 3.54 -3.56
Titanium 5.08-5.1
Tantalum 2.5
Chromium 12.1-12.2
Cobalt 12.1 -12.2
Tungsten 3.5
Molybdenum 1.9, wherein a metallurgical stability factor of said alloy is expressed by the formula $$N_{V3} = \sum_{i=1}^{n} m_i (N_V)_I$$

where $N_{V3}$ is between 2.390 and 2.400.

6. A lower longitudinally-stressed gas turbine component nickel-based alloy casting having a density of about 0.30 pounds per cubic inch, the nickel-based alloy comprising the following composition by weight percent:

Aluminum 3.31-3.57
Titanium 4.02-4.98
Tantalum 2.59-3.05
Chromium 11.93-11.97
Cobalt 11.96-12.04
Iron 0.01-0.15
Copper 0.01-0.10
Tungsten 3.08-3.65
Molybdenum 1.44-1.98
Carbon 0.066-0.072
Boron 0.010-0.012
Zirconium 0.1-10 parts per million
Hafnium 0.0-0.05
Sulfur 0.0001-0.0012
Nitrogen 0.01-19 parts per million
Oxygen 0.1-9 parts per million and, the remainder Nickel and incidental impurities wherein a metallurgical stability factor of the nickel-based alloy is expressed by a formula $$N_{V3} = \sum_{i=1}^{n} m_i (N_V)_I$$

where $N_{V3}$ of the casting is greater than or equal to 2.20 and less than or equal to 2.280 and wherein the tensile strength at 800 degrees F. is greater than or equal to 177 and less than or equal to 180.

7. A lower longitudinally-stressed gas turbine component nickel-based alloy casting having a density of about 0.30 pounds per cubic inch, the nickel-based alloy comprising the following composition by weight:

Aluminum 3.30-3.82
Titanium 5.1
Tantalum 2.4-3.0
Chromium 12.1
Cobalt 11.9-12
Iron 0.01-0.15
Copper 0.01-0.10
Tungsten 3.3-3.5
Molybdenum 1.5-2.0
Carbon about 0.04-0.12
Boron 0.010-0.020
Zirconium 0.1-20 parts per million
Hafnium 0.01-0.05
Sulfur 0.0001-0.0012
Nitrogen 0.1-25 parts per million
Oxygen 0.1-10 parts per million, and the remainder Nickel and incidental impurities, wherein the nickel-based alloy has a solution heat treatment window of at least 150 deg. F. in which a majority of a gamma prime strengthening phase dissolves, and wherein a metallurgical stability factor of the nickel-based alloy is expressed by a formula $$N_{V3} = \sum_{i=1}^{n} m_i (N_V)_I$$

where $N_{V3}$ of the casting is about 2.31.

* * * * *